United States Patent [19]

Debski

[11] 4,344,620

[45] Aug. 17, 1982

[54] EXERCISE VEST

[76] Inventor: Andre J. Debski, 4256 English Oak Dr., Doraville, Ga. 30340

[21] Appl. No.: 92,835

[22] Filed: Nov. 9, 1979

[51] Int. Cl.[3] ..... A63B 21/12; A63B 21/18

[52] U.S. Cl. ..... 272/119; 2/102; 272/DIG. 4

[58] Field of Search ..... 272/130, 128, 117, 116, 272/119; 2/2.1 R, 2.1 A, 67, 94, 81, 102

[56] References Cited

U.S. PATENT DOCUMENTS

| | | | |
|---|---|---|---|
| 728,745 | 5/1903 | Morrison | 9/338 |
| 1,046,068 | 12/1912 | Hebs | 9/342 |
| 1,064,743 | 6/1913 | Kepler | 9/333 |
| 1,111,222 | 9/1914 | Forrester | 2/2 |
| 2,313,151 | 3/1943 | Johnson | 9/338 |
| 3,279,102 | 10/1966 | Seeber | 272/119 X |

FOREIGN PATENT DOCUMENTS

| | | | |
|---|---|---|---|
| 218063 | 7/1967 | Sweden | 272/119 |
| 5960 | of 1903 | United Kingdom | 272/119 |

*Primary Examiner*—Richard C. Pinkham
*Assistant Examiner*—William R. Browne
*Attorney, Agent, or Firm*—Louis T. Isaf

[57] ABSTRACT

An exercise device comprising interconnected, water-tight compartments which define a vest for supporting a fluid weight medium from the shoulders and about the upper torso of a human exerciser. Water or other fluid is removeably introduced into the water-tight compartments in variable amounts to weight the vest for use by the exerciser. Air is introduced into the compartments to occupy space not occupied by the water in order to fill out the vest. The air and water is expelled from the compartments to facilitate easy and light-weight transportation of the vest.

3 Claims, 4 Drawing Figures

EXERCISE VEST

FIELD OF THE INVENTION

The present invention relates generally to the field of exercise equipment and more specifically to an exercise vest.

BACKGROUND OF THE INVENTION

There are numerous methods, means and devices for exercising. One of the methods of exercising which has found popularity among some exercisers is to don one's body with added weight and then to go about one's normal routine. The normal routine can be walking, running, bending, stretching and so on. Some of the devices employed by the exerciser in order to attach added weight to his body include ankle weights, weighted jackets and belt weights. These prior art devises have certain limitations and effects which have detracted somewhat from their popularity.

Ankle weights, to Applicant's mind, tend to pull harshly on the knee and ankle thus causing pain and possible damage. The weights are sewn or otherwise attached to a strap which is fastened about the ankle. The strap will usually slide uncomfortably up and down on the ankle bone while the exerciser is running. Shin splints are often said to result from the prolonged use of ankle weights.

Weight belts wrap around the waist and sit uncomfortably against the pelvic and hip bones. If there is enough weight in the belt to make it a desireable exercising aid, it generally restricts good, flexible movement, expecially when stretching or bending.

The weighted jackets with which the applicant is familiar extend beyond the waist and the jackets have pockets filled generally with buckshot or lead weights. The jacket tends to hit hard against the body while the user is running, and the jacket is somewhat bulky. All of these characteristics tend to limit the type of exercises, which can be performed while wearing the jacket. It would appear that only walking and jogging exercises can be performed while wearing the jacket. When transporting the prior art weighted jackets, both the weights and jacket must be transported together, resulting in excess bulk and excess weight.

SUMMARY OF THE INVENTION

Briefly described, the present invention comprises an exercise vest including compartments which may be filled with water and air. The water is the weight medium and can be utilized in varying amounts in order to vary the weight of the jacket. The air "fills-out" the vest, occupying the space in the vest compartments not occupied by the water. The vest is supported from the shoulders, and the vest fits snug about the chest of a user. Although weighted, the inflated state of the vest comfortably cushions the effect of the weight against the body of the user.

The vest of the present invention can be used by the general public and athletes alike while exercising. It can be used while jogging, running, walking, cycling, swimming, or in conjunction with most other physical exercise programs.

Therefore, it is an object of the present invention to provide an exercise device which is worn by the exerciser and which can be used in conjuction with a variety of physical exercise programs.

Another object of the present invention is to provide a comfortable weighted exercise device to be worn by a human user.

Yet another object of the present invention is to provide an exercise vest, the weight of which can be regulated between predetermined limits, and the shape of which can be maintained substantially constant despite a change in weight.

Other objects, features and advantages of the present invention will become apparent upon reading the following specification, when taken in conjunction with the accompanying drawing.

DETAILED DESCRIPTION

Figure 1:
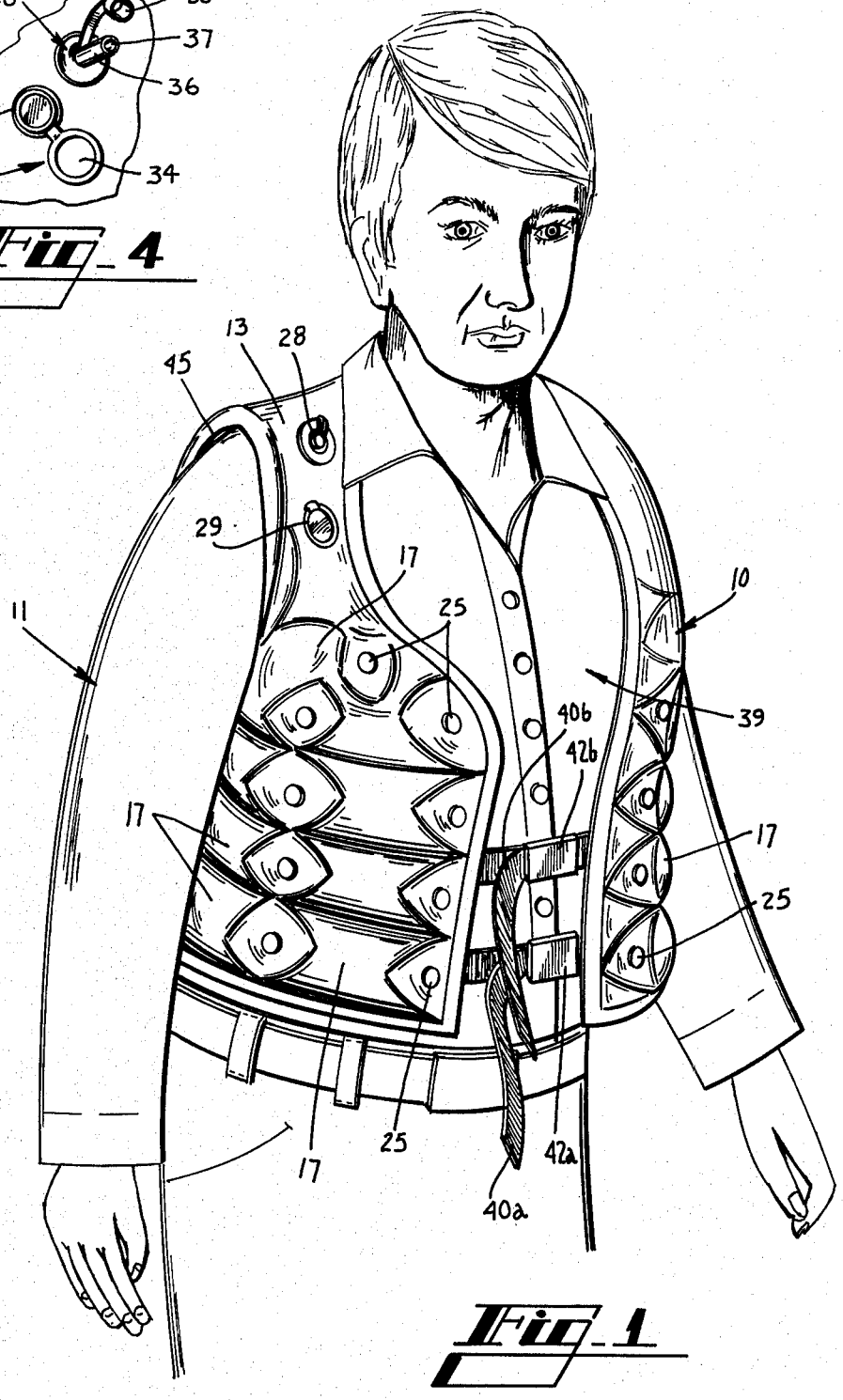
FIG. 1 is a pictorial view of the Exercise Vest in accordance with the present invention and worn by a human user.
Figure 3:
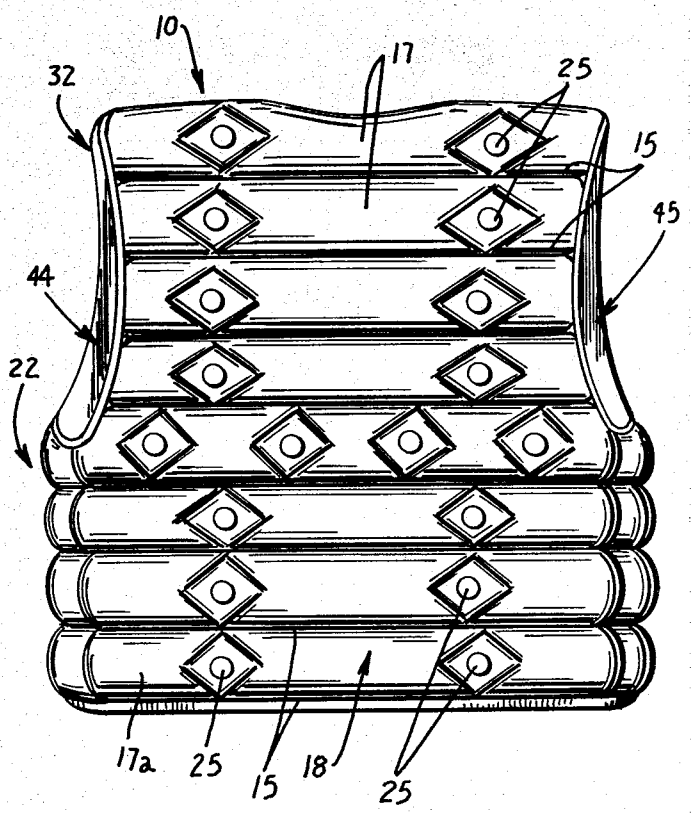
FIG. 3 is a rear pictorial view of the Exercise Vest in accordance with the present invention.
Figure 2:
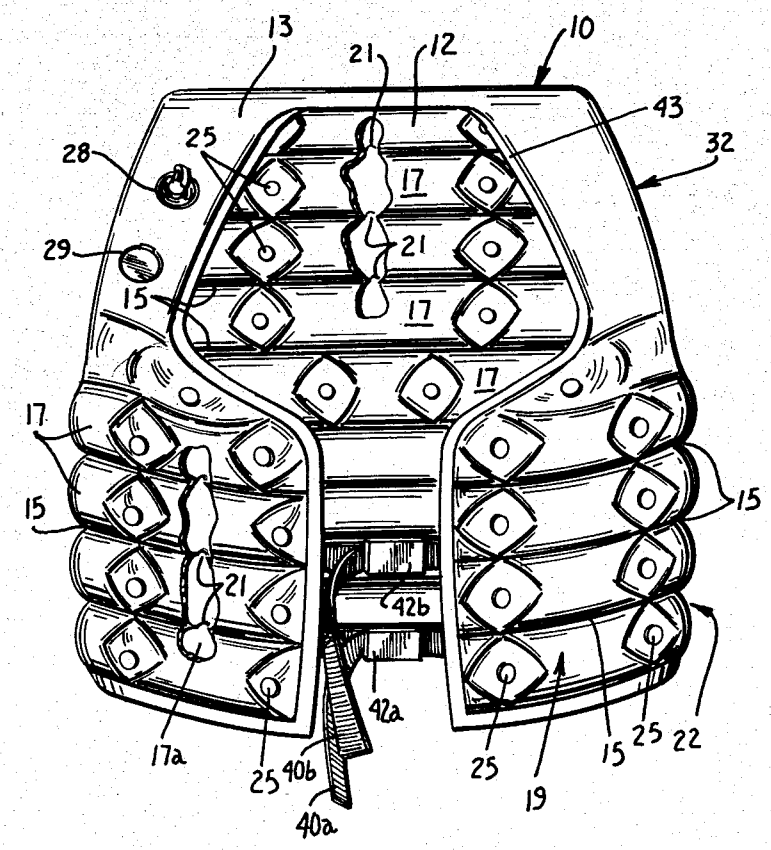
FIG. 2 is a front pictorial view of the Exercise Vest in accordance with the present invention, with parts broken away for clarity.

Referring now in greater detail to the drawings in which like numerals represent like components throughout the several views, FIG. 1 shows the exercise vest 10 of the present invention being worn by an exerciser 11. FIGS. 2 and 3 show the vest 10 in greater detail. The vest 10 comprises an inner liner 12 and an outer liner 13 sealed together at their edges to form an air tight/water tight compartment (not seen) between them. The inner liner and outer liner are sealed together again along weld lines 15 to form a row of parallel, horizontal, spaced-apart ribs 15 dividing the air tight/water tight compartment into a plurality of horizontally stacked chambers, preferrably tubular chambers, or conduits 17. The row of weld lines or ribs 15, in the preferred embodiment, continues substantially the entire height of the backside 18 of the vest 10, but does not continue the entire height of the frontside 19 of the vest 10, although it is within the scope of this invention to do so. Rather, in the preferred embodiment, as seen in the drawings, the ribs 15, and thus the tubular shaped conduits 17, are formed only along the lower vest region 22 of the frontside 19. The ribs 15 do not each form a continuous seal along its length, but rather, each rib 15 defines at least one small passage 21 interrupting the seal and communicating between the adjacent chambers or conduits 17. A plurality of spot welds 25, spots 25, are interspersed throughout the vest 10 sealing together the inner liner 12 and outer liner 13 again at predetermined locations.

Figure 4:
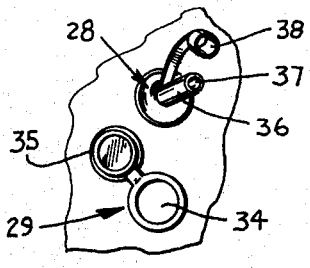
FIG. 4 is an isolated pictorial view of the fluid inlets of the Exercise Vest in accordance with a preferred embodiment of the present invention.

Two fluid inlets 28, 29 are defined in the outer liner 13 at the upper vest region 32 of the frontside 19 of the vest 10. As shown in FIG. 4, the lower inlet 29 comprises an opening 34 of, for example, approximately one inch diameter and a plug 35 for removable insertion in the opening. The upper inlet 28 comprises a valve or nipple 36 including a smaller diameter opening 37, for example, approximately one-quarter inch in diameter, and a plug 38 for removable insertion into the opening.

To use the exercise vest 10 of the present invention, the exerciser 11 or other user 11 introduces water, or other fluid weight medium, into the compartment through the opening 34 of the lower inlet 29. The opening 34 is wide enough to facilitate the use of a faucet or water hose. The water flows from the upper vest region 32 downward, passing successively through the tubular shaped conduits 17 to the lowermost conduit 17*a*. As the lowermost conduit 17*a* fills to its capacity, the water enters and fills the next higher conduit 17, and so on up the vest 10. The ribs 15 and spot welds 25 cooperate to minimize the shifting and sloshing of water during exercising and to prevent distortion of the vest, such as by ballooning.

Once the user 11 has introduced enough water into the vest 10 to produce the desired weight, he plugs the lower fluid inlet 29 using the plug 35. Then, using the upper fluid inlet 28, the user blows air into the vest 10, to occupy the space within the vest compartment not already occupied by water. Other embodiments of the invention may include only a single fluid inlet through which both the air and water are introduced into the vest. The air fills out the vest to maintain its shape and to insure a proper snug fit in accordance with the respective sizes of the user and the vest. A user 11 should choose the proper vest size by fitting the vest in its fully inflated state. The fluid, be it water or air, fills the compartment chambers of the upper vest region 32 about the neck and shoulders and serves to cushion the shoulder and neck of the user 11 from brusing and other effects of the added weight. In addition, the inflated nature of the vest 10, due to the water and air, cushions generally the entire body-vest contact areas. With the vest worn on his body and supported from his shoulders about his upper body or upper torso 39 (see FIG. 1), the user 11 fastens the buckles 42 on the straps 40*a*, 40*b* and pulls the vest to the desired tightness.

The air and water are easily expelled from the vest 10 by removing the plugs 35, 38 and pouring, squeezing and otherwise forcing the fluids out. With the water expelled, the vest is easily folded and transported in a suit case or gym bag.

Although it is preferrable to fill the upper vest region 32 with fluid to increase weight and/or enhance cushioning, it is within the scope of the invention to eliminate the fluid compartment of the upper vest region 32. In such an embodiment, the upper vest region 32 of the vest 10 functions solely as a means for supporting the fluid filled compartment of the lower vest region 22 from the shoulders of the exerciser 11. The fluid inlets 28, 29 in this alternative embodiment should be relocated to the lower vest region 22.

A specific example of the present invention is as follows: (see drawings) The exercise vest 10 comprises an inner liner 12 and an outer liner 13 made of vinyl or like water-tight, flexible material. The liners 12, 13 are sealed together at their outer edges to form a vest, open at the frontside 19 and including a widened neck region 43, and two opposing arm holes 44, 45. The vest 10 includes eight horizontally aligned, parallel, sealed, one-eight ($\frac{1}{8}$) inch wide ribs 15 of different lengths, at intervals of about two inches. Between adjacent ribs are reinforcement sealed spots or spot welds 25. There are two pairs of straps 40*a*, 40*b* including buckles 42*a*,42*b* attached to the lower vest region 22 at the open frontside 19.

While the ribs 15 of the preferred embodiments have been arranged horizontally, it is within the scope of the invention to align the ribs vertically or at any other orientation. It is the function of these ribs 15 to control the flow, movement and distribution of water in the vest and to aid in preventing distortion of the vest 10.

Whereas, the preferred embodiment of the present invention shows the vest being open and fastened at the frontside 19, it is within the scope of this invention to have the open and fastened portion anywhere about the torso circumference, for example, under the arms.

While this invention has been described in specific detail with particular reference to preferred embodiments thereof, it will be understood that variations and modifications can be effected within the spirit and scope of the invention as described herein before and as defined in the appended claims.

I claim:

1. An exercise vest for wearing about the upper torso by a human user, comprising:

a body portion, said body portion comprising an inner sheet and an outer sheet defining an air-tight and water-tight fluid compartment therebetween;

support means for supporting said body portion from the shoulders of the human user and below the shoulders of the user;

means for fastening said body portion about the chest and rib region of the human user;

a fluid inlet formed in said body portion and communicating with said fluid compartment; and partitioning means for partitioning said fluid compartment into a plurality of interconnected fluid channels, said partitioning means comprising a plurality of parallel line welds each joining together said inner and outer sheets of said body portion, and a passage defined in each of said line welds and communicating between adjacent ones of said fluid channels.

2. An exercise vest for wearing about the upper torso by a human user, comprising:

A body portion, said body portion comprising an inner sheet and an outer sheet defining an air-tight and water-tight fluid compartment therebetween;

support means for supporting said body portion from the shoulders of the human user and below the shoulders of the user;

means for fastening said body portion about the chest and rib region of the human user;

a fluid inlet formed in said body portion and communicating with said fluid compartment;

partitioning means for partitioning said fluid compartment into a plurality of interconnected fluid channels; and a plurality of spot welds interspersed about said body portion, each spot weld joining together said inner and outer sheets of said body portion.

3. An exercise vest for wearing about the upper torso by a human user, comprising:

A body portion, said body portion comprising an inner sheet and an outer sheet defining an air-tight and water-tight fluid compartment therebetween;

support means for supporting said body portion from the shoulders of the human user and below the shoulders of the user;

means for fastening said body portion about the chest and rib region of the human user;

a fluid inlet formed in said body portion and communicating with said fluid compartment;

partitioning means for partitioning said fluid compartment into a plurality of interconnected fluid channels; and a weighted, fluid medium retained in said fluid compartment.

* * * * *